United States Patent [19]

Remillard

[11] 4,394,817

[45] Jul. 26, 1983

[54] APPARATUS FOR MAKING AND MAINTAINING AN ICE SURFACE

[76] Inventor: Jean M. Remillard, 9390 Eastman, LaSalle, Quebec, Canada, H8R 2K8

[21] Appl. No.: 300,573

[22] Filed: Sep. 9, 1981

[51] Int. Cl.[3] ..... A63C 19/10

[52] U.S. Cl. ..... 62/235; 165/46

[58] Field of Search ..... 62/235; 165/46; 126/428, 448

[56] References Cited

U.S. PATENT DOCUMENTS

| | | | |
|---|---|---|---|
| 3,233,662 | 2/1966 | Yuen | 165/46 |
| 3,621,671 | 11/1971 | Ullrich | 62/235 |
| 3,751,935 | 8/1973 | MacCracken et al. | 62/235 |
| 3,893,507 | 7/1975 | MacCracken et al. | 62/235 |
| 4,066,063 | 1/1978 | Gross et al. | 126/448 |

*Primary Examiner*—Ronald C. Capossela

*Attorney, Agent, or Firm*—Swabey, Mitchell, Houle, Marcoux & Sher

[57] ABSTRACT

A plurality of flexible plastic strips made up of elongated extruded modules with each module including a plurality of parallel tubular sections spaced apart by continuous webs with each strip being laid out on an area on which ice is to be made. The tubular sections of the modules of each strip are individually connected to a supply header and a return header, and at the other end of the strip, a common closed header allows brine to be circulated through alternating tubes.

5 Claims, 5 Drawing Figures

APPARATUS FOR MAKING AND MAINTAINING AN ICE SURFACE

BACKGROUND OF THE INVENTION

1. Field of the Invention

The present invention relates to an apparatus for making and maintaining artificial ice surfaces, and more particularly, to a tubing arrangement to be removably laid out and disposed throughout an area on which the ice surface is to be formed.

2. Description of the Prior Art

Canadian Pat. No. 953,523 teaches the use of a plurality of small bore, flexible plastic tubing which has been preassembled into mats of multiple tube lengths, and each tube is individually connected to supply and return headers. Spaced-apart spacer attachments connect the tubes together and form a grid.

SUMMARY OF THE INVENTION

It is an aim of the present invention to provide an improved apparatus for making and maintaining an ice surface which is an improvement over Canadian Pat. No. 953,523 in that it provides a more uniform circulation of the refrigerant material, thereby producing a more uniform and even temperature gradient along the surface of the area covered by the tubes.

It is a further aim of the present invention to provide a method and apparatus which is more economical to manufacture and apply.

A construction in accordance with the present invention comprises a plurality of elongated strips adapted to be laid on a predetermined area, each comprising at least a strip module extending longitudinally, each strip module being a flexible extruded plastic member including a plurality of parallel tubular sections interspaced by integral web portions, the web portions being in a common place and the longitudinal edges of each module having web extensions forming wings adapted for attachment with similar wings of adjacent strip modules to form the strip.

In a more specific embodiment, alternating tubular sections of a strip are connected at one end of the strip to a supply header, and the remaining alternative tube sections being connected to a return header at the same end of the strip, and a common closed header being connected to each tubular section at the other end of the strip.

In a more specific embodiment of the present invention, each strip is made up of a plurality of modules connected along their respective wings, a plurality of strips being laid side by side on an area on which an ice surface is to be made and maintained.

Accordingly, the integral web construction of each strip prevents the tubular sections from being separated or undulating, thus maintaining a constant spacing between each tubular section and at even distance from ice sheet surface thereby enhancing the prevention of soft spots in the ice surface. Soft spots are formed coincidental with areas between tubes which have been separated due to the flexibility of the tubes between the attachments of the type shown in Canadian Pat. No. 953,523. Furthermore, it has been found that the provision of the integral and continuous webs between the tube sections provides a greater surface of thermal conductivity in contact with the water or ice so formed, thereby presenting a more efficient and greater uniformity of the thermal gradient across the ice surface, besides avoiding necessity of adding other matters, such as sand and masonary.

Each independently laid strip is made up as described by extruded flexible plastic modules. In a very specific embodiment, each module is made up of five tube sections with integral webs and wings. Each strip includes nine modules attached along their respective wings. The labour required for assembling the various strips is greatly reduced as compared to the assembly of the mats described in Canadian Pat. No. 953,523, given the fact that the individual tubes are extruded and must be assembled to form the net.

The supply and return header arrangement is also an improvement as the tubular sections need not be bent or otherwise adapted for the return flow of the refrigerant liquid. A closed header connects all of the tubular sections of the strip at one end thereof, offering a pool of liquid for the return, thereby decreasing the pressure loss at the remote end of the tubular sections. The header diameter being several times larger than flexible tubes, lower flow rate and avoidance of obturation.

The continuous webs between the tube sections may be provided with apertures to allow water to seep below the webs and air to escape from beneath at start-up. At the same time, the drainage of water is sufficiently controlled in order to speed up the formation of initial ice.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
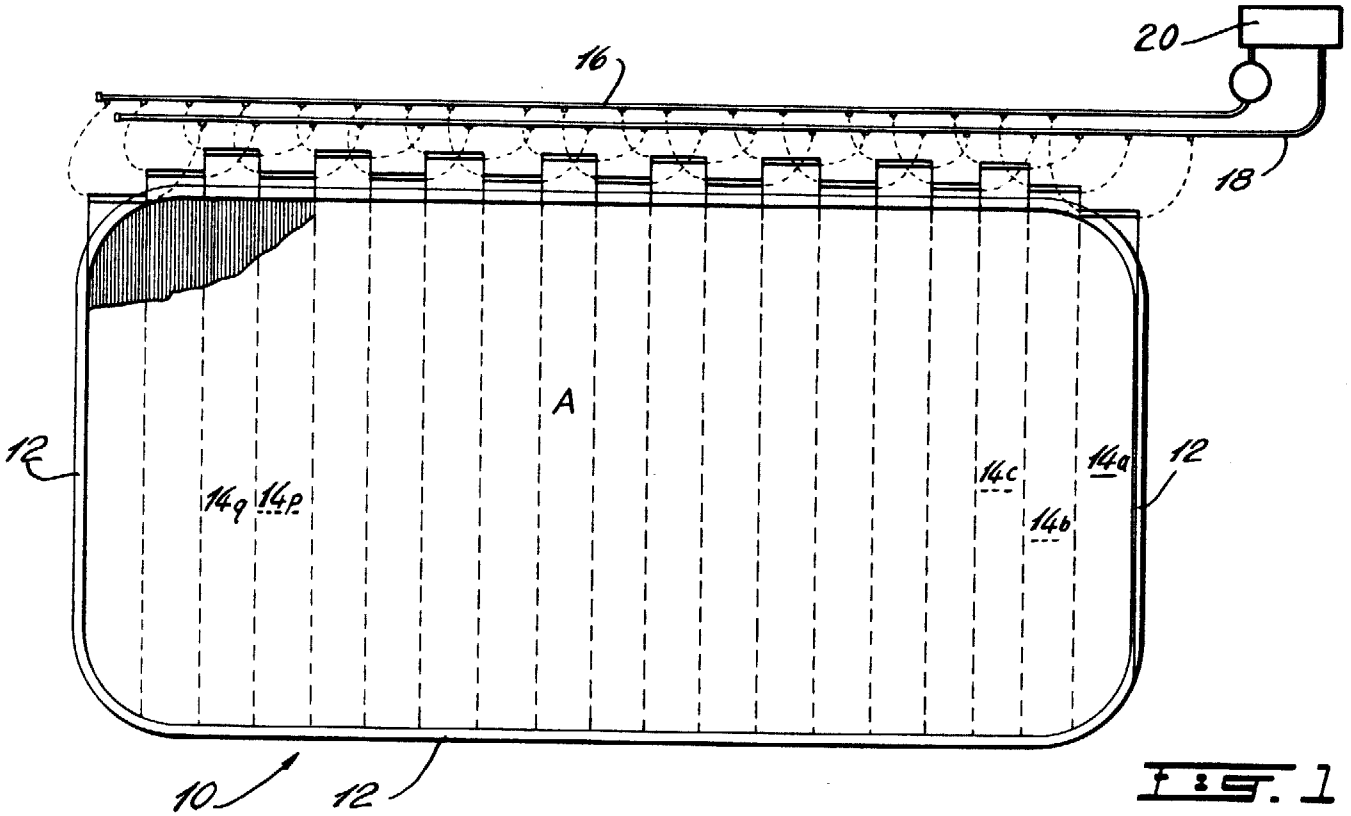
FIG. 1 is a top plan schematic view of a typical ice hockey rink embodying an ice making apparatus in accordance with the present invention.

Referring now to the drawings and particularly FIG. 1, there is shown a typical ice hockey rink 10 having peripheral boards 12 defining an ice surface area A. The area A is covered, in the present embodiment, with a plurality of strips 14*a*, 14*b*, 14*c* . . . with the longitudinal axis of the strips extending laterally of the area A, the strips being laid side by side to cover the total area.

As in a conventional ice making apparatus, there is a refrigeration plant 20 adapted to circulate brine or other refrigerating fluid through supply pipes 16 and return pipes 18.

Figure 2:
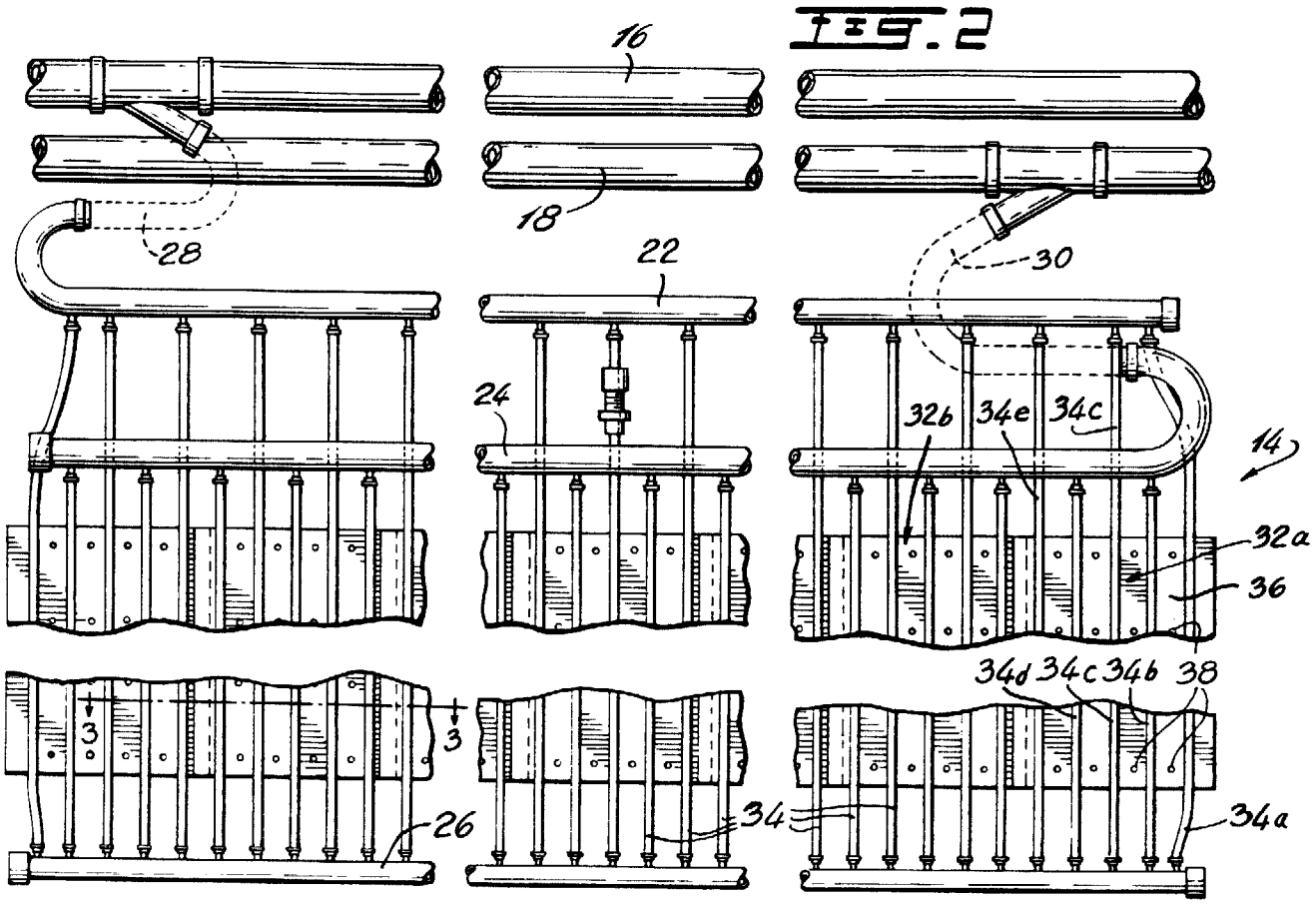
FIG. 2 is a fragmentary top plan view showing details of the apparatus illustrated in FIG. 1.

Each of the strips 14*a*, 14*b*, 14*c*, is provided with an individual supply header 22 and a return header 24 at one end of the strip 14, as shown in FIG. 2. At the other end of the strip, a closed header 26 is also provided. The supply header 22 and return header 24 communicate with the supply pipe 16 and return pipe 18 respectively by means of respective flexible hoses 28 and 30.

Figure 4:
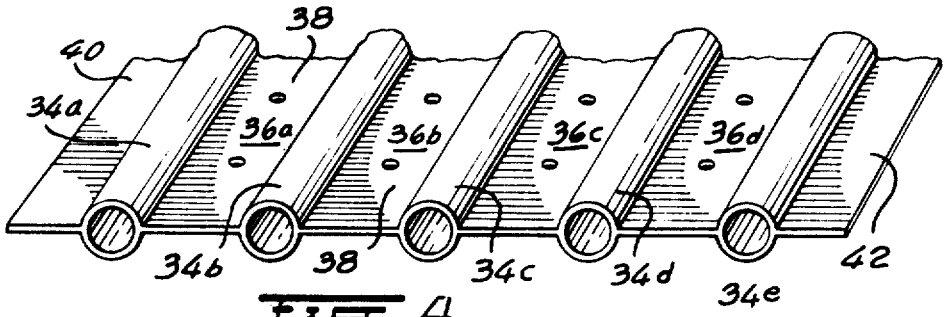
FIG. 4 is a perspective enlarged fragmentary view of a detail of the present invention.
Figure 3:
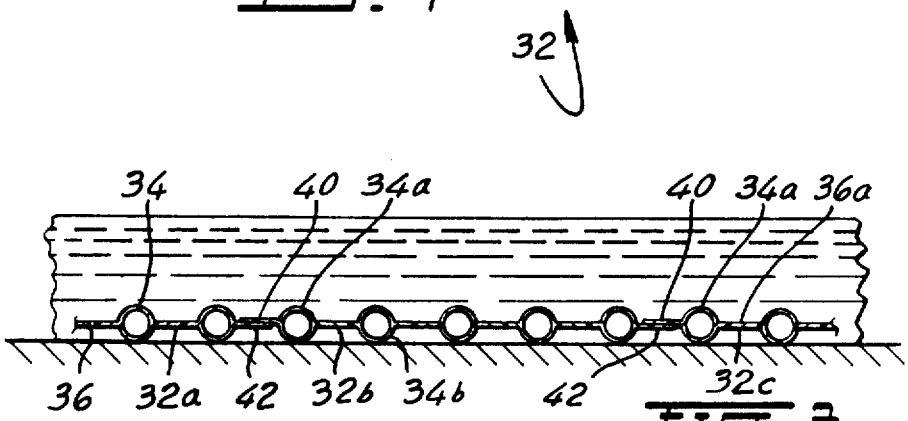
FIG. 3 is a vertical cross-section taken along line 3—3 of FIG. 2.

Each strip 14 is made up of a plurality of modules 32*a*, 32*b* . . . , as shown in FIG. 2. Each module 32 is an extrusion of approximately 5¾ inches wide and cut in lengths of 85 feet, and is preferably made of ethylene vinyl acetate (or other flexible and compatible material). Each extruded module 32, as shown in FIGS. 3 and 4, includes five tube sections 34*a*, 34*b*, 34*c*, 34*d* and 34*e* spaced by integral webs 36*a*, 36*b*, 36*c* and 36*d*. Extending from the exterior tubular sections 34*a* and 34*e* but in the same plane as the webs 36*a*, etc., are wings 40 and 42. In the makeup of a strip 14, the wings 40 are attached to wings 42 of adjacent modules 32. The attachments may be in the form of snap fasteners (or other convenient methods) spaced apart along the length of the wings 40 and 42 (not shown).

Each tube section 34 has an internal diameter of 0.23 inches, more or less, a wall thickness of 0.030 inches, and the tubular sections are spaced apart a distance of 1.062 inches from center to center. The distance from the centerline of the outermost tubular sections 34*a* and 34*e* to the edge of the wings 40 and 42 respectively is 0.75 inches. As mentioned above, the module is made of E.V.A. as supplied by DuPont under the trade mark ALATHON. The E.V.A. material can be transparent or white-opaque, but should be treated for resistance against ultraviolet rays. The thickness of the webs 36 and wings 40 and 42 is 0.020 inches. The webs 36 may be provided with apertures 38.

A typical strip 14 includes five modules with the respective wings 40 and 42 overlapping and fastened together, as shown in FIG. 2. The overall width of the module is 5.75 inches. A strip 14 having nine modules would average a width of approximately 4.0 feet.

An odd number of tubular sections 34 are provided in each module 32, and the outermost tubular section 34*a* of the outermost module 32*a* is connected to the supply header 22. Alternating tubular section 34*b* is, in turn, connected to the return header 24. Thus, the outer tubular sections of the strip 14 can easily be arranged to be connected to the supply header.

At the other end of the strip 14, each of the tubular sections 34*a*, 34*b*, etc., are connected to the closed header 26.

It is also noted, as shown in FIG. 2, that the supply header is fed by the flexible hose 28 at one edge of the strip 14, in this case from the right-hand side with the closed end of the header 22 at the opposite or left-hand edge of the strip 14, while the return header 24 is arranged in opposite fashion such that it is connected by means of the return hose 30 on the left-hand side of the strip 14 with the closed end of the header at the right-hand side of the strip 14. This will allow a more even balance of the refrigerant circulating through the strip 14 since the first fed brine will theoretically be the coldest and will be passing on the right-hand side of the strip 14, while theoretically the first brine being returned comes from the tubes 34*b* and 34*d* on the left-hand side of the strip 14. By the same token, the closed header 26 at the other end of the strip 14 presents a common pool of refrigerant material which would theoretically keep a mean temperature throughout, and thus the temperature of the return brine is more closely related to the temperature of the supply brine. In the case of the curved corner areas, a separate header 26 would be provided for each module 32*a*, 32*b* . . . and each module forming a strip 14 could thus be cut in a stepped arrangement to approximately the curve of the boards 12.

Figure 5:
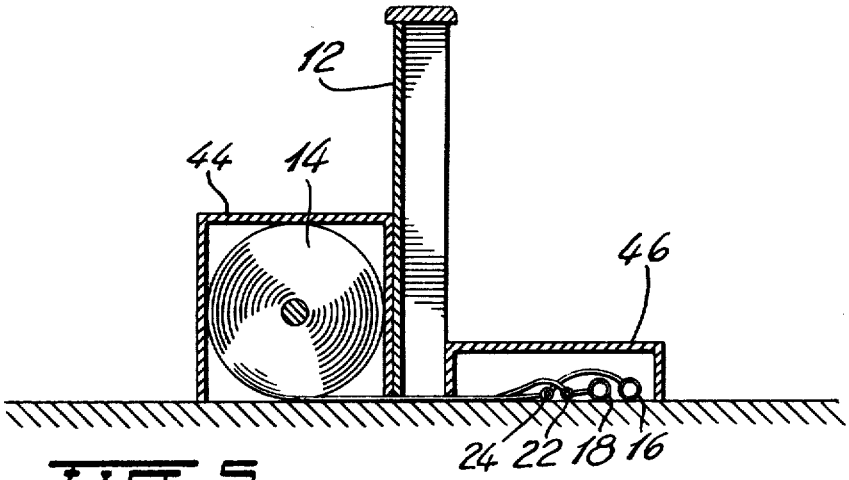
FIG. 5 is a vertical cross-section showing an embodiment of the present invention in a stored inoperative position.

In the off-season or when the surface of the rink is required for other purposes than for ice skating, the individual strips 14 are rolled as shown in FIG. 5 and are stored underneath the box 44 next to the boards 12. The supply and return pipes as well as the headers of the individual strips may be permanently concealed on the other side of the boards or off ice areas under a cover 46.

When it is required to provide an ice surface on the area A, the individual strips 14 are unrolled over a level surface made of a suitable base. The closed headers 26 also act as a weight to hold down and even the individual strips 14 at the other end thereof. As in conventional ice making equipment, a refrigerant fluid, such as brine, at low temperature, is pumped through the supply pipe 16 through respective flexible hoses 28 to respective supply headers 22 for each strip 14. The fluid then passes through each individual tubular section 34*a*, 34*c*, 34*e*, etc., to the other end of the strip 14 into the closed header 26, and brine is returned through the return tubular sections 34*b*, 34*d*, etc., to the return header 24, flexible hose 30, and return pipe 18 back to the refrigeration plant.

It has been found that the integral web construction of the module 32 provides a greater heat exchange surface to the water which is poured on the laid-out strips 14, and a typical calculation indicates that the heat exchange surface exposed thereby is approximately 2.34 square feet of exposed heat exchange surface for each square foot of area being covered. Accordingly, a more efficient arrangement is being provided by the present construction, providing closer temperature differential between average ice temperature and brine temperature, meaning higher brine temperature as well as expansible primary refrigerant, and therefore lower electrical power consumption, faster setting up of ice, because of the permanent uniform disposition of the strips of flexible tubes.

I claim:

1. In an apparatus for making and maintaining an ice surface, a plurality of elongated strips adapted to be laid on a predetermined area, each strip comprising at least a strip module extending longitudinally of the strip, each strip module being a flexible extruded plastic member including a plurality of spaced-apart parallel tubular sections interspaced by integral uninterrupted web portions, the web portions being in a common plane, and the longitudinal edges of each module having web extensions forming wings adapted for attachment with similar wings of adjacent strip modules to form the strip; and wherein alternating tubular sections of each module forming a strip communicate with a supply header for supplying a flowable refrigerant thereto, and the remaining tubular sections in the strip communicate with a return header at the same end of the strip, and a common closed reverting header is connected to each tubular section of the strip at the other end of the strip.

2. An apparatus as defined in claim 1, wherein each unitary extruded strip module includes five tubular sections.

3. An apparatus as defined in claim 2, wherein each strip includes nine modules and the strip has an approximate width of 4 feet.

4. An apparatus as defined in claim 3, wherein the supply header is arranged to feed a refrigerant fluid to the individual tubular sections making up the strip from a first side edge of the strip to the other side edge of the strip, while the return header is arranged to withdraw fluid from the first side edge of the strip through to the other side edge of the strip, each apparatus being an autosufficient heat exchanger that can be integrated to an ice body to efficiently withdraw any importing forms of heat energy, without necessitating intermediate mass such as sand, concrete, etc.

5. An apparatus as defined in claim 2, wherein each strip module has an overall width of 5.75 inches, and the internal diameter of each tubular section is 0.23 inches more or less.

* * * * *